US007814877B2

(12) United States Patent
Sato et al.

(10) Patent No.: US 7,814,877 B2
(45) Date of Patent: Oct. 19, 2010

(54) INTAKE MANIFOLD WITH REINFORCING PARTITIONS

(75) Inventors: Shingo Sato, Nagoya (JP); Yasutoshi Kameda, Toyota (JP)

(73) Assignee: Denso Corporation, Kariya (JP)

( * ) Notice: Subject to any disclaimer, the term of this patent is extended or adjusted under 35 U.S.C. 154(b) by 311 days.

(21) Appl. No.: 12/081,834

(22) Filed: Apr. 22, 2008

(65) Prior Publication Data

US 2008/0283015 A1 Nov. 20, 2008

(30) Foreign Application Priority Data

May 15, 2007 (JP) ..... 2007-128800

(51) Int. Cl.
*F02M 35/10* (2006.01)

(52) U.S. Cl. ..... 123/184.47; 123/184.42

(58) Field of Classification Search .....
123/184.24–184.26, 184.34–184.36, 184.42–184.44, 123/184.47–184.49, 184.53
See application file for complete search history.

(56) References Cited

U.S. PATENT DOCUMENTS 6,802,293 B2 10/2004 Iwata et al.

FOREIGN PATENT DOCUMENTS

| | | |
|---|---|---|
| JP | 3-275971 | 12/1991 |
| JP | 2001-041119 | 2/2001 |
| JP | 2006-177222 | 7/2006 |

OTHER PUBLICATIONS

Japanese Office Action dated Apr. 21, 2009, issued in corresponding Japanese Application No. 2007-128800, with English translation.

*Primary Examiner*—Noah Kamen
(74) *Attorney, Agent, or Firm*—Nixon & Vanderhye PC

(57) ABSTRACT

An intake manifold is provided with partitions which divide the lower space formed under opening ends. An intake air is prevented from flowing into the lower space by the partitions. Since the intake air can be efficiently suctioned to each opening ends, pressure loss of the intake air can be reduced.

5 Claims, 4 Drawing Sheets

INTAKE MANIFOLD WITH REINFORCING PARTITIONS

CROSS-REFERENCE TO RELATED APPLICATION

This application is based on Japanese Patent Application No. 2007-128800 filed on May 15, 2007, the disclosure of which is incorporated herein by reference.

FIELD OF THE INVENTION

The present invention relates to an intake manifold which introduces intake air to each cylinder of an engine.

BACKGROUND OF THE INVENTION

JP-2003-269271A (U.S. Pat. No. 6,802,293B2) shows an intake manifold. One end of an intake pipe is connected to a cylinder head of an engine and the other end is connected to a surge tank in such a manner as to project into an interior of the surge tank. Intake air flows into a space formed under the projected end of the intake pipe in the surge tank, which causes an increase in pressure loss of the intake air.

SUMMARY OF THE INVENTION

The present invention is made in view of the above matters, and it is an object of the present invention to reduce a pressure loss of an intake air in an intake manifold in which an open end of an intake pipe is projected into an interior of a surge tank.

According to the present invention, an intake manifold includes a plurality of intake pipes. The intake pipes have connecting ends respectively connected to intake ports of a cylinder head of an engine and opening ends aligned in a row in such a manner as to project into a surge tank. The intake manifolds includes an intake air introducing port formed at one side of the row of the opening ends of the intake pipes. A space is formed under the opening ends in the surge tank. The intake manifold includes a partition dividing the space in a direction of the row.

When the intake air is introduced from the intake air introducing port toward the space, the intake air is prevented from flowing into the space by the partitions. Hence, the intake air is effectively suctioned into each of cylinders so that pressure loss of intake air is reduced.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

First Embodiment

Figure 1:
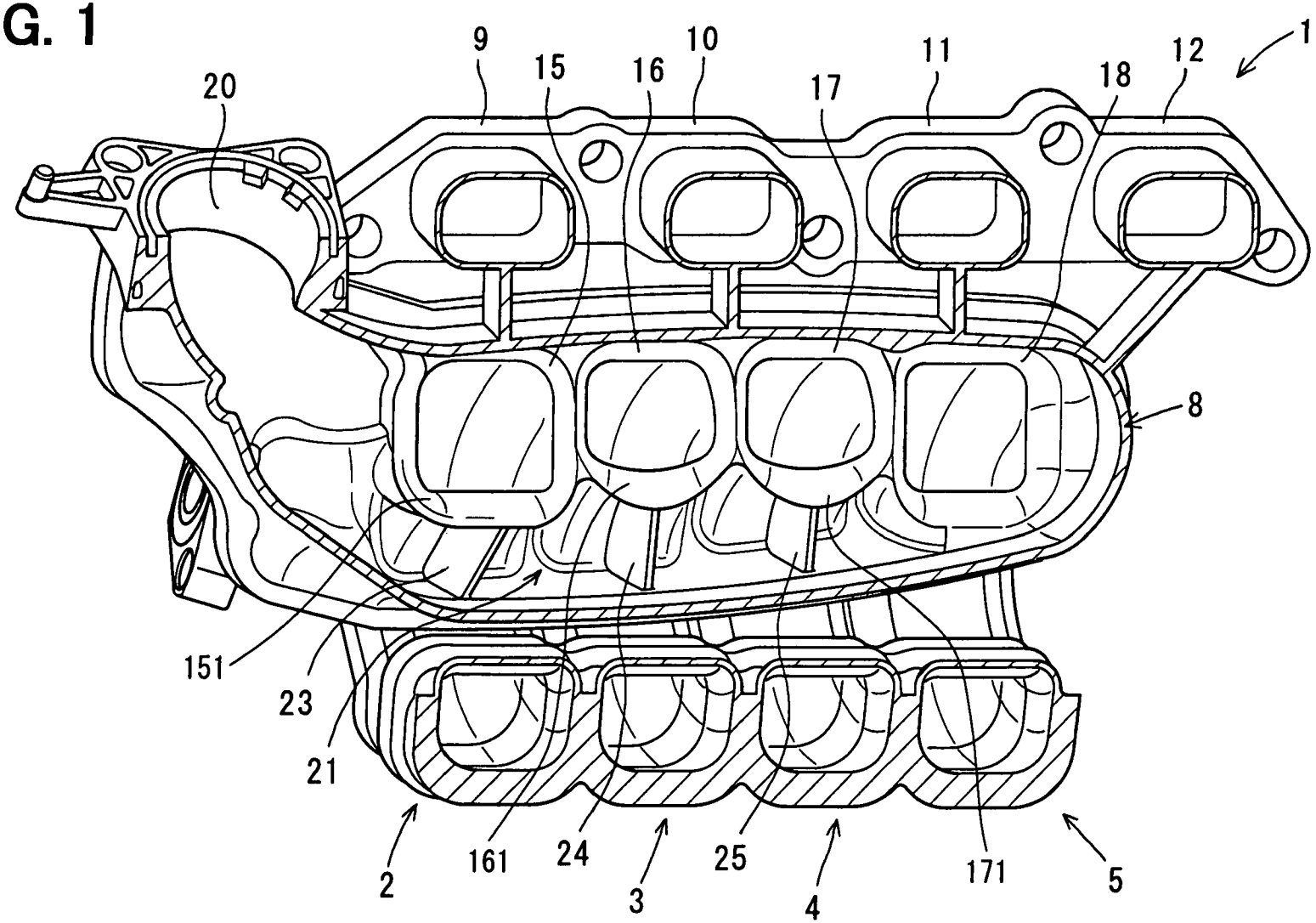
FIG. 1 is a perspective view showing an interior of an intake manifold according to a first embodiment.
Figure 2:
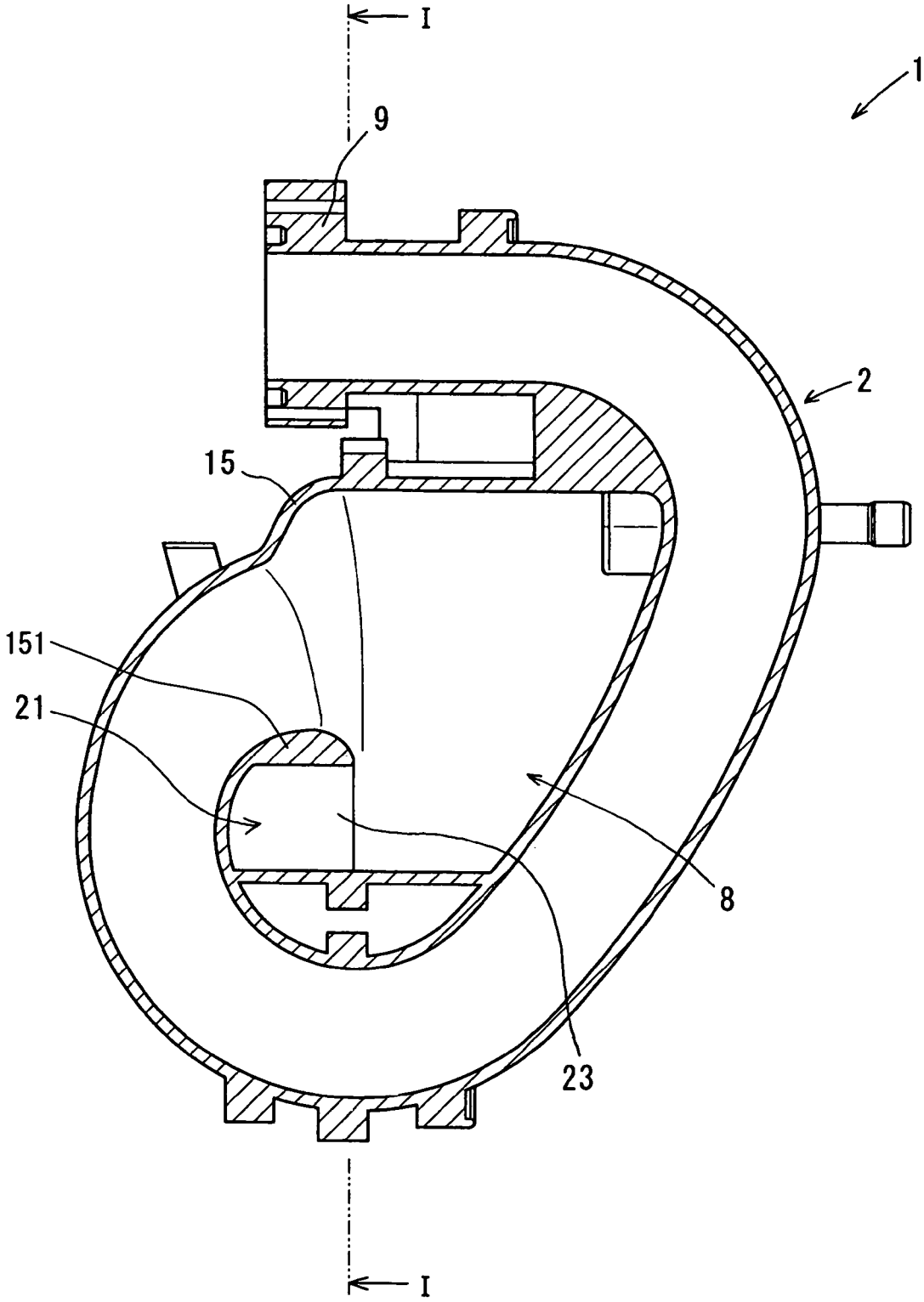
FIG. 2 is a cross sectional view of the intake manifold.

Referring to FIGS. 1 and 2, an intake manifold 1 of a first embodiment is described. The intake manifold 1 is for introducing intake air into each cylinder of a four-cylinder engine (not shown). The intake manifold 1 is provided with four intake pipes 2-5 which are connected to intake ports (not shown) of a cylinder head.

The intake pipes 2-5 extend along an outer surface of a surge tank 8. The intake pipes 2-5 have connecting ends 9-12 connected to the cylinder head and opening ends 15-18 projected into an interior of the surge tank 8. These opening ends 15-18 are aligned in one direction. In this embodiment, the opening ends 15-18 are aligned in a horizontal direction. An intake air introducing port 20 is provided on left side of the opening ends 15-18.

The intake manifold 1 is provided with three partitions 23-25 which horizontally divide a lower space 21 formed under the opening ends 15-18. The partitions 23-25 extend downwardly from a center of projecting walls 151, 161, 171 of the opening ends 15-17 to an inner surface of the surge tank 8.

Advantage of the First Embodiment

The intake manifold 1 is provided with the partitions 23-25 which divide the lower space 21 formed under the projecting walls 151, 161, 171 of the opening ends 15-17.

When the intake air flows from the intake air introducing port 20 in a right direction, the intake air is prevented from flowing into the lower space 21 by the partitions 23-25. Hence, the intake air is effectively suctioned into each of cylinders 2-5 so that pressure loss of intake air is reduced.

Figure 3:
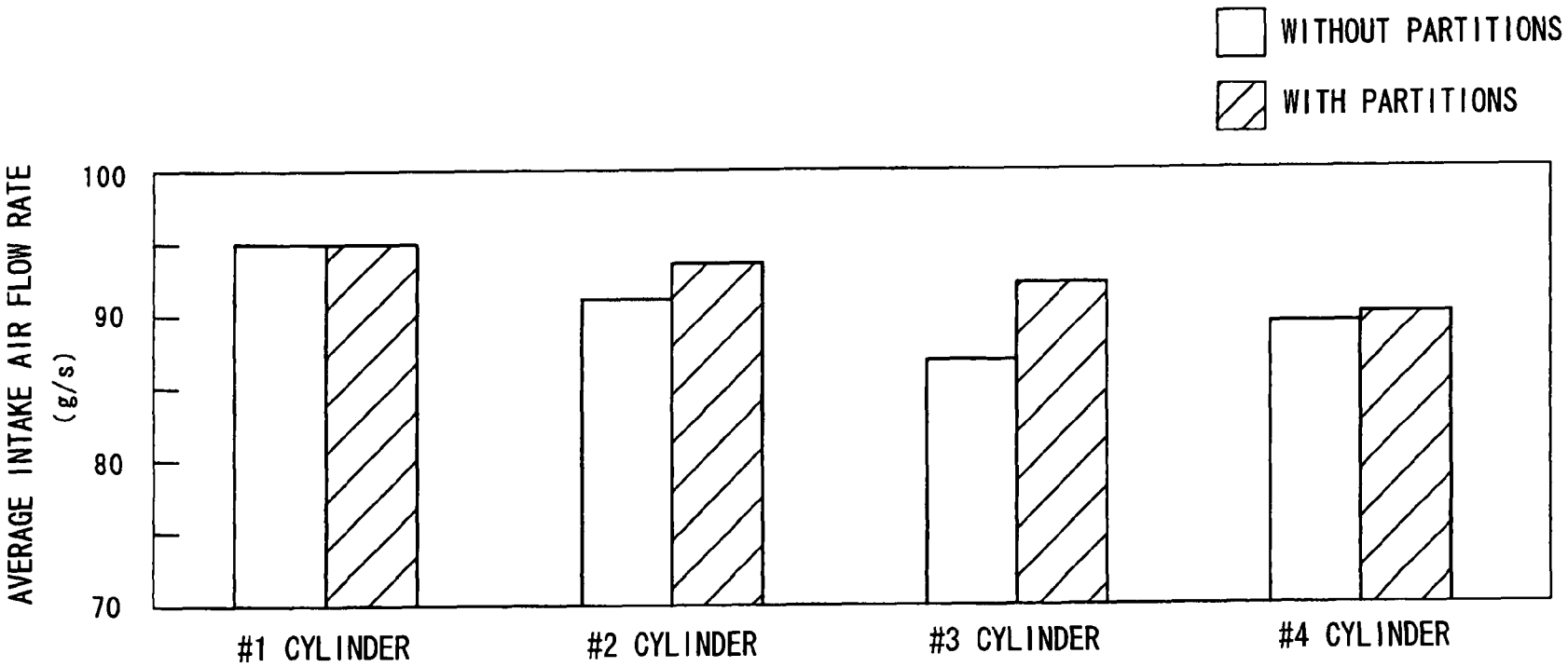
FIG. 3 is a graph showing advantages of partitions.

In a case that a differential pressure between the intake air introducing port 20 and the connecting ends 9-12 is 50 mmHg and an engine speed is in a rage of 700-1000 rpm, FIG. 3 shows a comparative result of an average intake air flow rate in the four-cylinder engine between a case that the partition 23-25 are provided and a case that no partitions are provided. The average intake air flow rate is more increased and the pressure loss is more decreased in a case that the partitions 23-25 are provided than a case that no partitions are provided.

The partitions 23-25 extend from a center of projecting walls 151, 161, 171 of the opening ends 15-17 to an inner surface of the surge tank 8. The partitions 23-25 function as ribs to enhance mechanical strength of the intake manifold 1.

Second Embodiment

Figure 4:
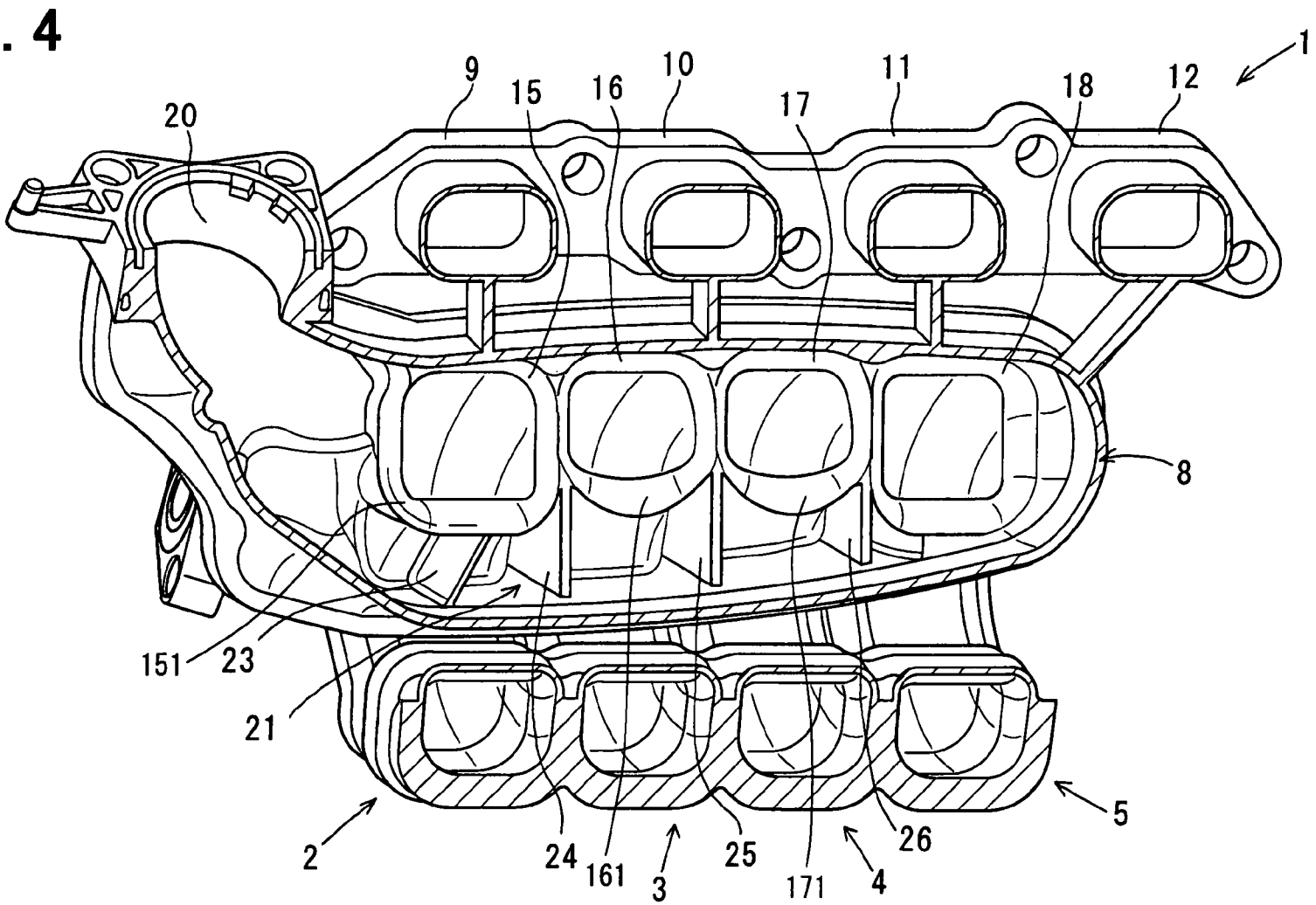
FIG. 4 is a perspective view showing an interior of an intake manifold according to a second embodiment.

According to a second embodiment, as shown in FIG. 4, the intake manifold 1 is provided with four partitions 23-26. The partition 23 extends from a center of the projecting wall 151 of the opening end 15 to an inner surface of the surge tank 8. The other partitions 24-26 respectively extend from connecting portions between the opening end 15 and opening end 16, between the opening end 16 and the opening end 17, and between the opening end 17 and the opening end 18 toward the inner surface of the surge tank 8. Since the partitions 23-26 are provided under all of the opening ends 15-18, the intake air is prevented from flowing into the lower space 21 under all of the opening ends 15-18. Hence, the pressure loss of the intake air is surely reduced.

MODIFICATIONS

In the first embodiment, three partitions 23-25 are provided, and in the second embodiment, four partitions 23-26 are provided. Alternatively, the partition 23 only may be provided under the opening end 15. Even when a single partition is provided, the pressure loss is effectively reduced.

In the first and the second embodiment, adjacent opening ends 15-18 are respectively in contact with each other. Alternatively, the opening end 15 and the opening end 16 may be formed in a manner to make a clearance therebetween and the partition 24 may be provided in the clearance.

The engine is not limited to the four-cylinder engine. The present invention can be applied to a three-cylinder engine, a six-cylinder engine, and an eight-cylinder engine. The present invention can be applied to an inline four-cylinder engine, a V-type engine, and a horizontally-opposed engine.

What is claimed is:

1. An intake manifold comprising:

a plurality of intake pipes having connecting ends respectively connected to intake ports of a cylinder head of an engine and opening ends aligned in a row in such a manner as to project into a surge tank;

an intake air introducing port formed at one side of the row of the opening ends of the intake pipes; and at least one partition dividing a space formed below the opening ends in the surge tank, the at least one partition dividing said space in a direction of the row, wherein each partition extends downwardly from an outer wall of one of the open ends to an inner surface of a bottom of the surge tank and functions as a reinforcing rib.

2. An intake manifold according to claim 1, wherein one of the at least one partitions is provided under the opening end which is closest to the intake air introducing port.

3. An intake manifold according to claim 2, wherein a plurality of said partitions are provided, one said partition extending downwardly from each said opening end.

4. An intake manifold according to claim 1, wherein the opening ends are aligned horizontally.

5. An intake manifold according to claim 1, wherein a plurality of said partitions are provided, one said partition extending downwardly from between each pair of adjacent opening ends.

* * * * *